US005210520A

United States Patent [19]

Housley

[11] Patent Number: 5,210,520

[45] Date of Patent: May 11, 1993

[54] PROGRAMMABLE DOORBELL CONTROL

[76] Inventor: Todd B. Housley, 7605 Mabray Dr., Plano, Tex. 75025

[21] Appl. No.: 735,096

[22] Filed: Jul. 23, 1991

Related U.S. Application Data

[63] Continuation of Ser. No. 408,613, Sep. 18, 1989, abandoned, which is a continuation-in-part of Ser. No. 73,456, Jul. 15, 1987, Pat. No. 4,868,540.

[51] Int. Cl.[5] ..... G08B 27/00

[52] U.S. Cl. ..... 340/326; 340/392; 340/330

[58] Field of Search ..... 340/326, 330, 328, 329, 340/392, 393; 379/103

[56] References Cited

U.S. PATENT DOCUMENTS

| | | | |
|---|---|---|---|
| 2,343,009 | 2/1944 | Hall | 340/330 |
| 3,964,058 | 5/1976 | Winston | 340/330 |
| 4,326,276 | 4/1982 | Scott, Jr. | 368/10 |
| 4,715,060 | 12/1987 | Lipscher et al. | 379/70 |
| 4,868,540 | 9/1989 | Housley | 340/326 |

*Primary Examiner*—Jin F. Ng
*Assistant Examiner*—Jeffery A. Hofsass

[57] ABSTRACT

A programmable doorbell system includes a battery-powered doorbell control for connection in series with an existing doorbell pushbutton in a residential doorbell circuit. In a first embodiment, the doorbell control has a visual LCD display which can display one of a plurality of messages. A manual switching mechanism is provided for selecting one of the messages for display. By utilizing an internal time of day clock, the residence occupant can program the control for a time interval during which the normal doorbell is disconnected from the doorbell switch. During this time interval, the doorbell control sounds a tone alarm and displays the selected message if the doorbell switch is pressed by a visitor. A second embodiment is disclosed which utilizes a digital record/playback circuit to record an audible announcement by the occupant and store the recorded announcement as digital signals. An audible announcement is generated from the stored digital signals when the doorbell pushbutton is pressed by a visitor.

20 Claims, 8 Drawing Sheets

PROGRAMMABLE DOORBELL CONTROL

This application is a continuation, of application Ser. No. 07/408,613, filed Sep. 18, 1989 now abandoned which is a continuation in part of an application entitled, PROGRAMMABLE DOORBELL CONTROL, filed Jul. 15, 1987 by Todd Housley and assigned Ser. No. 073,456 now U.S. Pat. No. 4,868,540.

FIELD OF THE INVENTION

This invention relates to controllers and more particularly to a doorbell controller.

BACKGROUND OF THE INVENTION

In the past a doorbell switch, annunciator, and chime device included a case having a lower window for displaying a name card, an upper window for displaying messages, and a doorbell pushbutton switch located between them. A dial was provided around the pushbutton switch; the dial was manually set to identify the expected return time of an absent occupant. Lamps were positioned behind the upper slot of illuminating a photographic film positioned in the upper slot. The photographic film contained the messages the occupant desired to display. The lower slot was designed to receive a name card for display. A two way switch was connected between the pushbutton switch, lights, and chime. The switch could be thrown to a first position to connect the lights to a source of power to illuminate the message and to break the doorbell circuit and to a second position to turn off the lights and connect the doorbell. Those persons skilled in the art desiring more information of this prior art device are referred to U.S. Pat. No. 2,343,009 issued Feb. 29, 1944 to J. A. Hall.

Another prior art device included a musical door chime connected to a clock for annunciating the time. The device includes a read only memory (ROM) for storing a repertoire of musical tunes, one of which is displayed when a doorbell pushbutton switch is pressed. The tune to be played is selected by a keyboard connected to a microprocessor. The microprocessor reads from memory each digitally-encoded musical note for a note strike and decay circuit. This circuit converts the digital note to analog signals for energizing a loudspeaker. In addition, a clock generates the time for the microprocessor to automatically ring the chimes to indicate the hour of the day. Those persons skilled in the art desiring more information for this device are referred to U.S. Pat. No. 4,326,276 issued Apr. 20, 1982 to W. M. Scott, Jr.

Other prior art doorbell devices of interest includes a door signal regulator circuit which rings the bell at a constant rate regardless of whether the pushbutton is depressed only momentarily or for a long period of time (U.S. Pat. No. 2,909,771 issued Oct. 20, 1959). Another doorbell with hour-of return indicator, includes a doorbell enabling switch and two dials (hours and minutes) concentrically mounted about the pushbutton switch for setting and lighting the time of return in a window when the doorbell is cut off and enabling the doorbell when non lettered spaces of the dials are positioned in the window. Still another door signal device includes a key-controlled lock switch to provide a visual indication when the occupant is absent and has locked his door. The doorbell is cut off when the door is locked (U.S. Pat. No. 2,039,975 issued May 5, 1936).

Major differences between the prior art devices and the present invention exist. The programmable doorbell control device of the present invention is a low power device connectable to existing household wiring. The device has automatic and manual modes of operation. The automatic mode provides a means of disabling and re-enabling the doorbell by programming the device to perform these functions at a specified time. When disabled, the device will display a selected one of a plurality of messages and sound an audible tone when the button is pressed, in order to direct the visitor's attention to the displayed message. When desired, the manual mode is selected to override the automatic operation mode. The device continuously displays the name of the party occupying the home.

Thus, a visitor pushing a button hears a tone directing his attention to the display for receiving a message. A repertoire of messages is provided including a PLEASE KNOCK message to localize the sound when an occupant such as, for example, a baby is sleeping and not to be disturbed Or, if the occupant is a daytime sleeper, a DAYTIME SLEEPER message, or, if the occupant does not want to be disturbed, a DO NOT DISTURB message can be displayed. These differences constitute features which are all advantages over the prior art.

However the above described doorbell control is inconvenient if it is to be sold or used in several different countries where different languages are spoken. In this case the messages which are displayed must be reprogrammed in each language before the device can be used. Accordingly, a second embodiment is disclosed in which a recording and playback device is used to first record a message spoken by the user in his native language and, subsequently, to playback the recorded message when the doorbell button is pushed. The recording and reproducing capability can be used either with or without the internal timer.

SUMMARY OF THE INVENTION

Accordingly, it is an object of this invention to provide a low cost programmable doorbell control system.

Another object of the invention is to provide a doorbell having automatic and manual operational modes.

Yet another object of the invention is to provide a doorbell having an instructional information message display capability.

Still another object of the invention is to provide a doorbell control system which automatically disables and enables the doorbell at preselected times.

A further object of the invention is to provide a doorbell in which an audible message can be recorded by the user and reproduced when the doorbell is operated.

Still a further object of the invention is to provide a doorbell in which audible messages can be recorded and played back using low cost circuitry.

Briefly stated, the invention provides a programmable doorbell device for either automatically or manually controlling the operation of a doorbell depending upon the positioning of a mode selection switch.

In the automatic mode, a controller interfaces with the operator, keeps the time of day, controls the enabling and disabling of the doorbell, controls a tone generator, and controls a display. Thus, the occupant enters his name, selects a message for display, sets the clock to the time of day, and sets the times for enabling and disabling the doorbell. When the doorbell pushbutton switch is pressed, the tone generator generates a tone for directing a visitor's attention to the display and the display displays an informational message selected from a repertoire thereof. The name of the house occupant is continuously displayed.

In the manual mode, the controller is bypassed and control of the doorbell is returned directly to the doorbell s pushbutton switch.

In the second embodiment, an audible announcement is recorded using digital technology. In particular, the occupant records a message by speaking into a microphone. The analog signals generated by the microphone are encoded into digital signals by means of a speech-encoding integrated circuit. The resulting digital signals are stored in an integrated circuit memory. Later, when the doorbell is pushed, the stored digital signals are retrieved from the memory and provided to an integrated circuit speech synthesizer which generates audio analog signals. The audio signals are amplified and used to drive a speaker which generates the audible message.

BRIEF DESCRIPTION OF THE DRAWING

Other objects and features of the invention will become more readily understood from the following detailed description of the invention when read in conjunction with the accompanying drawings in which.

DETAILED DESCRIPTION OF PREFERRED EMBODIMENTS

Figure 1:
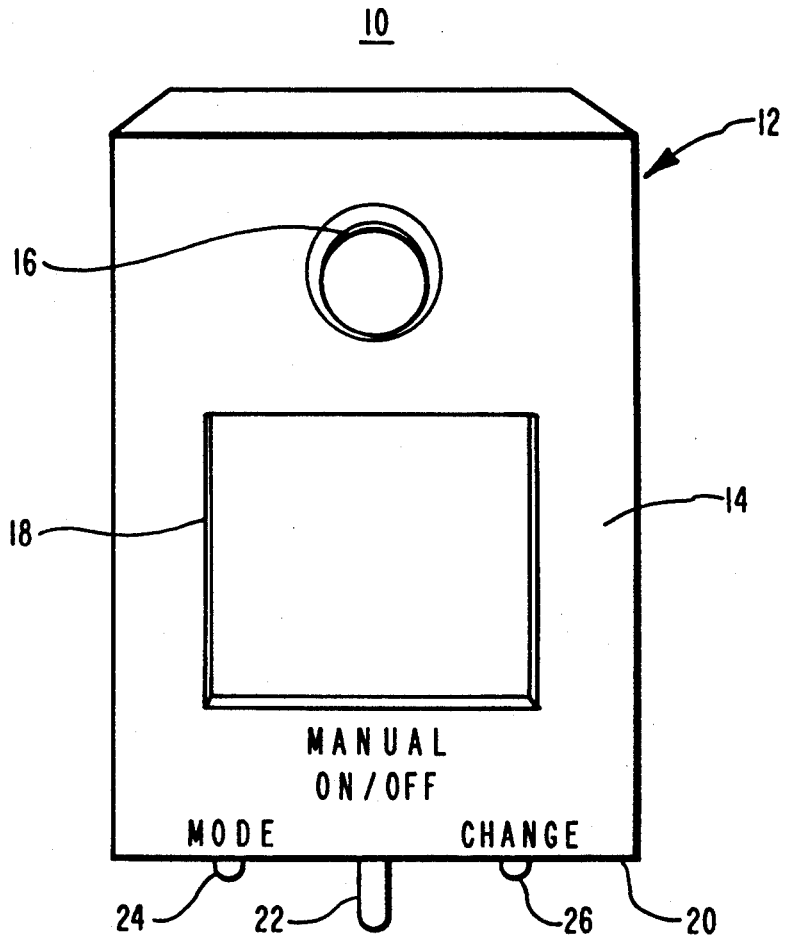
FIG. 1 is an isometric view of the programmable doorbell device.

The programmable doorbell device 10 (FIG. 1) includes a housing 12 having a front panel 14. The front panel includes a pushbutton switch 16 and a display such as, for example, a liquid crystal display 18. The housing 12 also has a bottom 20 having mounted therein control switches including a switch 22 for selecting either the automatic or manual operation mode, a mode pushbutton switch 24 and a change pushbutton switch 26. The mode and change pushbutton switches 24 and 26 are for setting and changing the operational parameters of the programmable doorbell device 10. The housing 12 houses the circuitry including the electronic circuitry for the programmable doorbell device 10.

The electronic circuitry 28 (FIG. 2) for the solid state programmable doorbell device 10 includes a power source 30 connected by leads 32 and 33 for supplying power to a controller 34, liquid crystal display (LCD) 18 and tone generator 36. The power source is separate from the house power supply. It comprises a small, inexpensive watch battery; thus, existing electric doorbell switches are replaced without requiring the expertise and expense of an electrician nor any change in the house wiring. The control switches, including the mode switch 24, change switch 26 and manual switch 22, are typical state of-the-art switches connected to the controller for purposes hereinafter described. The switches provide a short pulse to a detection circuit. Debouncing circuitry is in the controller to minimize the external component count and to simplify the manufacturing process.

The controller 34 is connected by bus 42 to the LCD display which includes the display drivers. The LCD display bus 42 includes an 8-bit data bus, a 4-bit address (character select) bus, a strobe signal line to synchronize communication between the display and the display control circuit and a blink line which, when active high, causes the character being sent to be blinked on the display. In the preferred embodiment, it is not necessary for the display to get data for the messages from the display control circuit; all that is needed is a pointer directing the display to the correct message.

The display 18 is a three-segment LCD display of typical LCD display construction. The display includes a twelve-character display segment for the occupant's name and two seven-character display segments for the information message to be displayed. The controller 34 is also connected by leads 44 and 46, respectively, to the tone generator 36 and doorbell control circuit 48 for control purposes.

The tone generator is a typical tone generator including an oscillator and transducer. When the tone strobe output of the controller becomes active, the oscillator will engage and provide a short tone burst to the transducer for generating an audible frequency suitable for signalling purposes. While, the doorbell control circuit includes an electronic switch, such as, for example, a TRIAC having its gate connected to a bell enable control output of the controller. The TRIAC controls the application of household power to a suitable electric doorbell 50 connected in series therewith. Thus, if the bell enable signal is active and the doorbell button pressed, the bell will ring in the house; otherwise, if the bell enable signal is not active and the button pressed, the bell will not ring.

Figure 3:
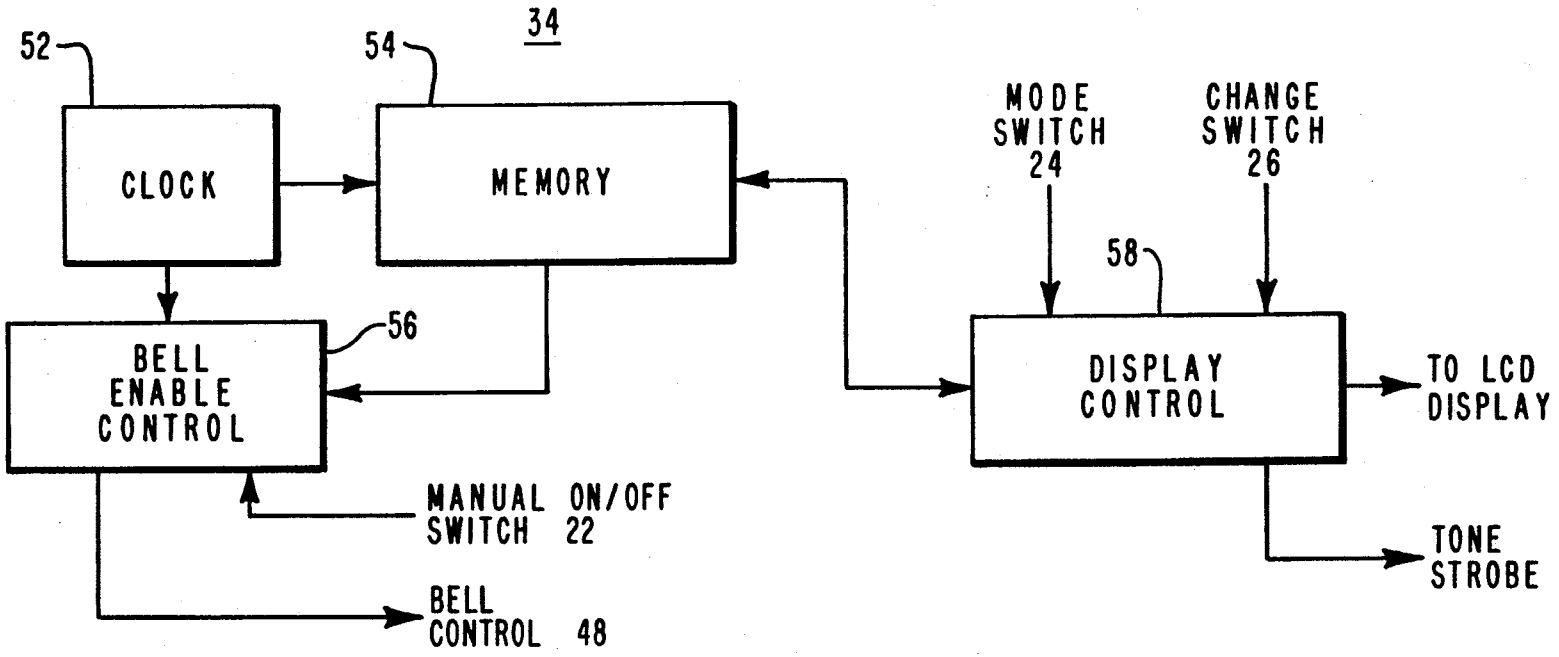
FIG. 3 is a block schematic diagram of the controller for the programmable doorbell device.

Referring now to FIG. 3, the controller 34 includes a clock 52 connected to a memory 54 and a bell enable control circuit 56. The memory 54 is connected to a display control 58 and to the bell enable control circuit 56. The bell enable control circuit 56 is connected to the manual on/off switch 22 and to the bell control circuit 48. The display control 58 is connected to the mode switch 24 and change switch 26 and outputs control signals to the LCD display and tone strobe signals to the tone generator.

The function of the clock 52 is to fetch the present time of day from memory, wait one minute and write the new time back to the time of day register in memory 54. The clock includes an oscillator and a counter not shown. Once the correct count is observed at the counter output, a minute has expired causing the memory to be updated with the new time.

The memory 54 stores all of the programmed information. The only parameter which will be altered once the device is programmed is the time of day which changes by the minute.

The display control 58 supplies the custom LCD with the data to be displayed in the twelve character name display. The display 18 (FIG. 2) is used while programming in order to prompt the operator for the required parameters and it also displays the house occupant's name during normal operation. Thus, the data displayed in this segment of the display is changed depending upon the operation mode.

In operation, the display control 58 (FIG. 3) provides the LCD with a stream of 12 one byte ASCII coded characters, a 4-bit decoding nibble, a strobe pulse and a blink character signal. The display control circuit also provides the display with a 2-bit disable message select signal.

Figure 2:
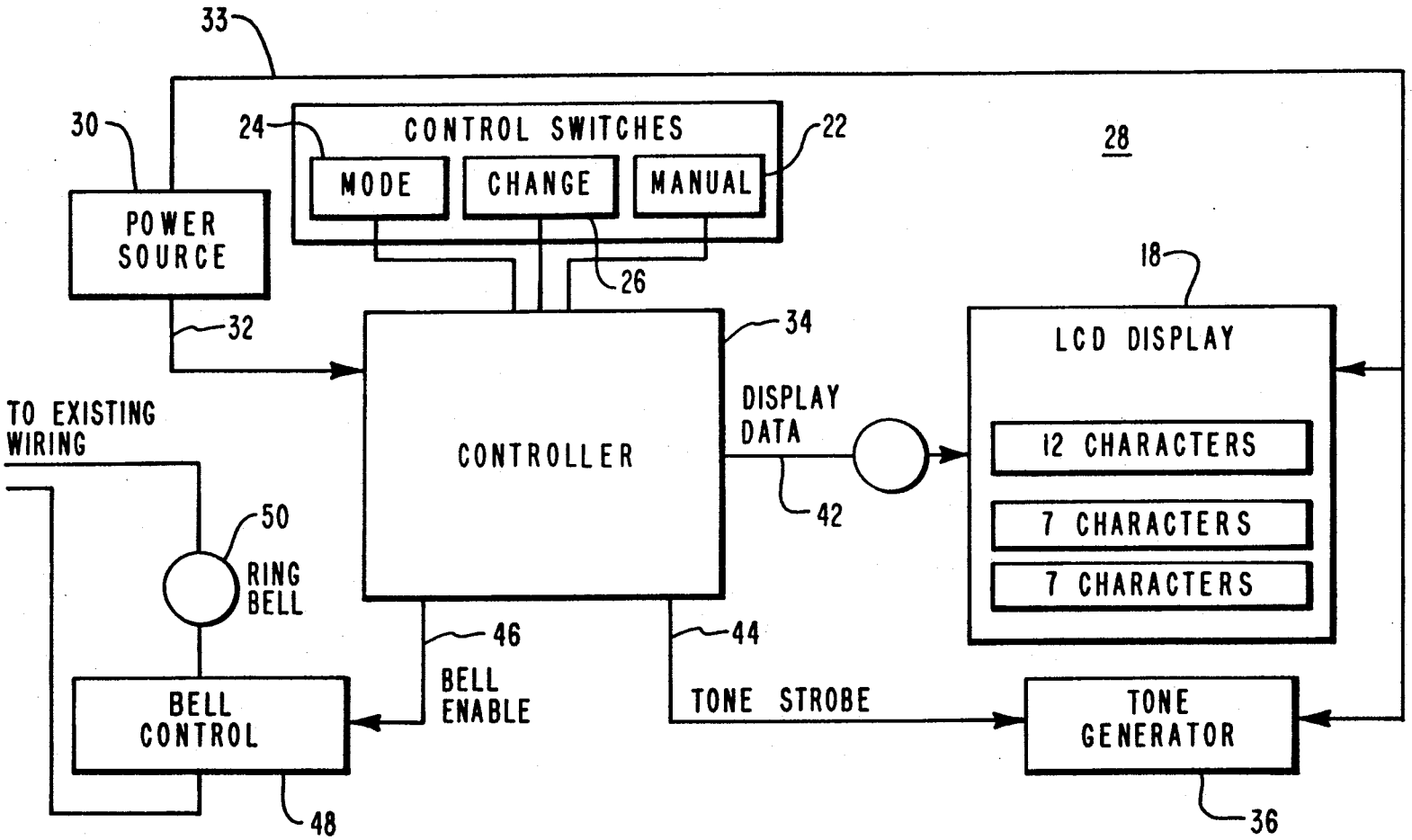
FIG. 2 is a block schematic diagram of the programmable doorbell device circuit.

The display control 58 interfaces with the operator through the mode and change switches 24 and 26 (FIG. 2). The display control circuit (FIG. 3) detects the pressing of the mode switch and increments the parameter in memory pointed to by an address counter to the next value each time the change switch is pressed. This circuit enters the normal operation mode when the last parameter is entered and the mode switch is pressed. In the normal operation mode, the name and message to be displayed are sent to the display 18.

The doorbell enable control circuit 56 fetches the bell disable time and the time of day from memory, compares them and determines if the doorbell should be disabled. Once disable, the circuit fetches the enable time and the time of day and compares those to determine if the doorbell should again be enabled. Thus, the circuit will provide the doorbell control 48 (FIG. 2) an active high signal at the doorbell enable output when the doorbell is enabled and an inactive low signal when the doorbell is disabled. The circuit also monitors the manual on/off switch; while in the manual on position, all other functions of this circuit are disabled.

FLOWCHART

Figure 4A:
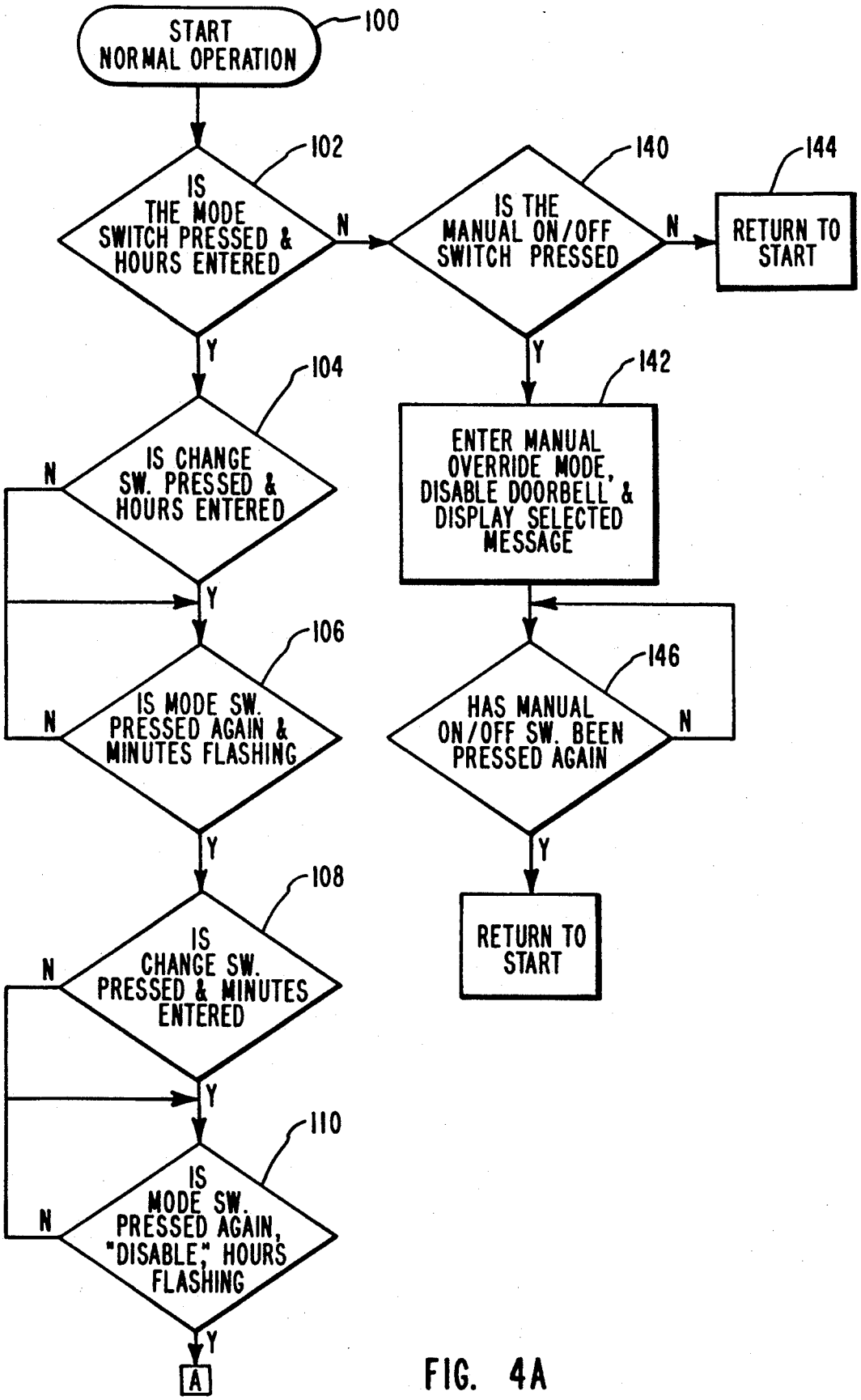
FIG. 4 is a flowchart for setting the operational parameters of the programmable doorbell device.
Figure 4B:
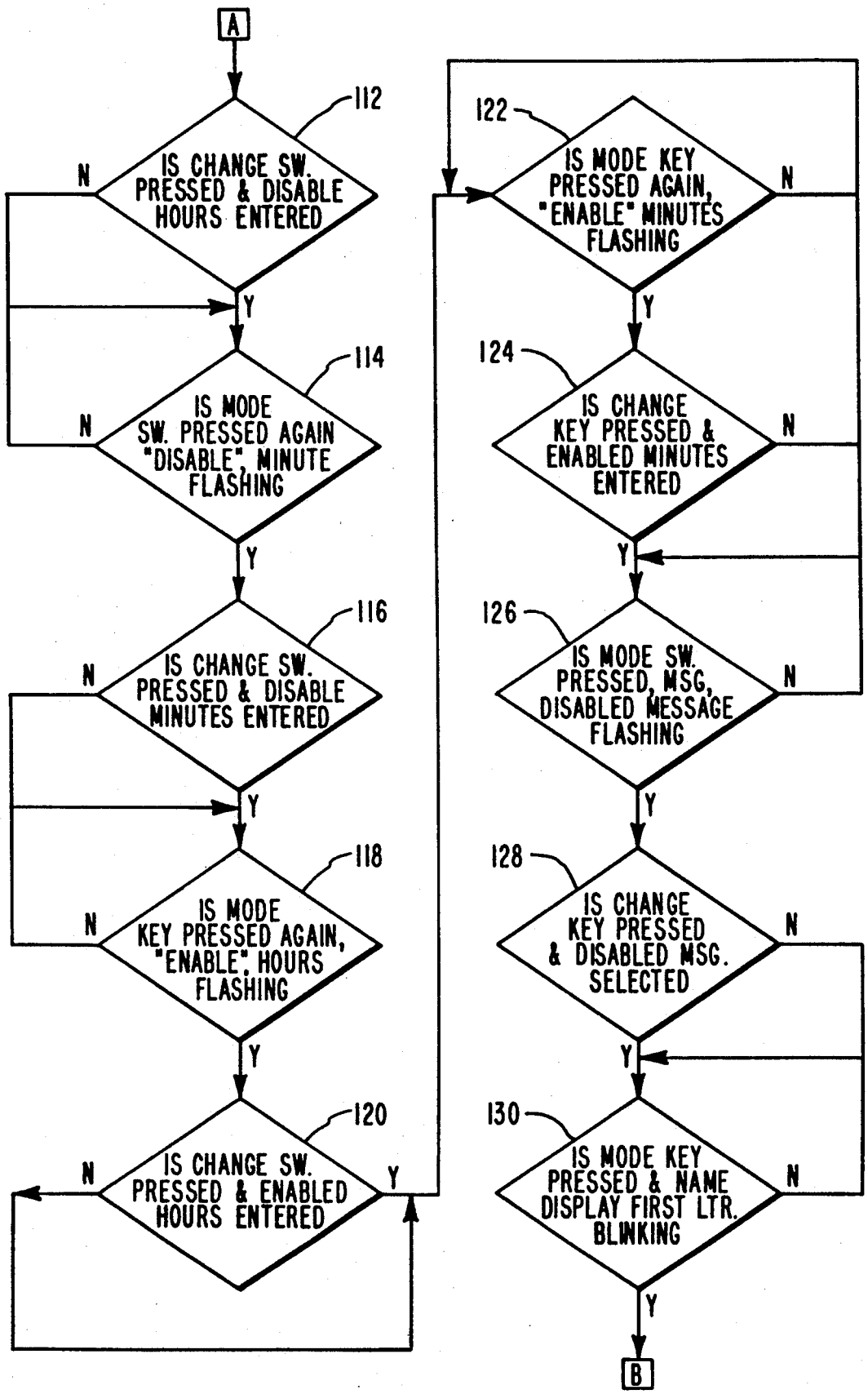
Figure 4C:
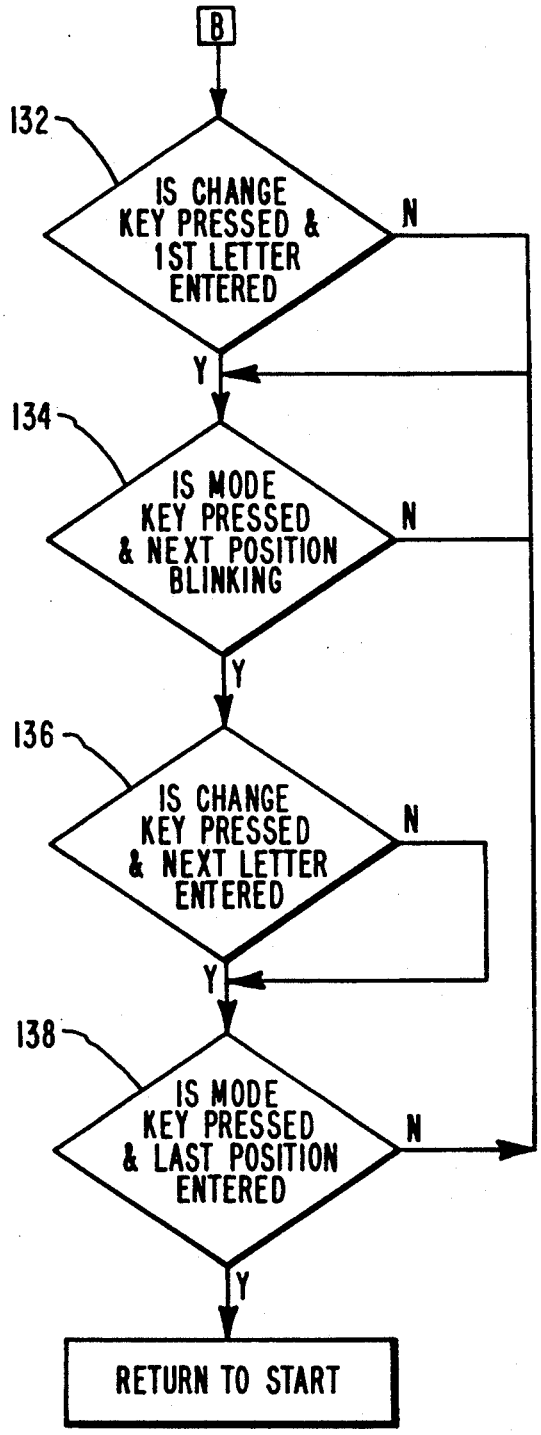

The programming of the controller is described in connection with a flowchart (FIG. 4) as follows.

At start 100, with the doorbell in normal operation, to set or correct the clock's time of day, a decision 102 is made whether the mode switch has been pressed and the hours display blinking; else a manual on/off switch subroutine beginning with decision 140 is entered. If decision 102 is yes, a decision 104 is made whether the change switch has been pressed and the hour entered; if yes, a decision 106 is made whether the mode switch has been pressed again, else the decision 106 is made directly whether the mode switch has been pressed again. When decision 106 is yes, a decision 108 is made whether the change switch has been pressed and minutes entered; if yes, a decision 110 is made whether the mode switch has been pressed, a "DISABLE" message displayed and hours flashing; else decision 110 is made directly.

When decision 110 is yes, the mode switch has been pressed again, a "DISABLE" message displayed and the disable hour display blinking, a decision 112 is made whether the change switch has been pressed and the disable hour entered; if yes, a decision 114 is made whether the mode switch has been pressed, the "DISABLE" message displayed and the disable minutes display blinking, else the decision 114 is made directly. When decision 114 is yes, a decision 116 is made whether the change switch has been pressed and the disable minutes entered; if yes, decision 118 is made whether the mode key has been pressed an "ENABLE" message displayed and the enable hours display blinking, else decision 118 is made directly.

When decision 118 is yes, the mode key has been pressed and the enable hours display is blinking, a decision 120 is made whether the change switch has been pressed and enable hours entered; if yes, a decision 122 is made whether the mode key has been pressed, the "ENABLE" message displayed and the enable minutes display blinking, else decision 122 is made directly. When decision 122 is yes, a decision 124 is made whether the change switch has been pressed and the enable minutes entered, if yes, a decision 126 is made whether the mode switch has bee pressed a "MESSAGE" message displayed and the disabled message display blinking, else the decision 126 is made directly. When decision 126 is yes, a decision 128 is made whether the change key has been pressed and the disable message selected; if yes a decision 130 made whether the mode switch has been pressed and the first letter of the name display blinking; else decision 130 is made directly.

When decision 130 is yes, a decision 132 is made whether the change key has been pressed and a first letter entered. If decision 132 is yes, a decision 134 is made whether the mode switch has been pressed and the next letter position blinking; else decision 134 is made directly. If decision 134 is yes, a decision 136 is made whether the change key has been pressed and the next letter entered. When decision 136 is yes, a decision 138 is made whether the mode key has been pressed and the last position entered; else decision 138 is made directly. When decision 138 is yes, return is made to start, else return is made to step 134 and steps 134, 136 and 138 repeated until decision 138 is yes and return is made to start (normal operation).

Returning now to decision 140, the manual on/off switch subroutine begins with the decision 140 as to whether the manual on/off switch is in the on position; if yes, an instruction 142 is issued to override the mode, disable doorbell, and display selected message; else an instruction 144 is issued to return to start 100. After instruction 142 is issued, a decision 146 is continuously made to determine whether the manual on/off switch has been pressed again; if yes, return is made to start, else the decision 146 is continuously made until the decision is yes and return is made to start for normal operation.

It will be appreciated by those skilled in the art that this flowchart logic can be implemented using the state-of the art gate array technology. Thus, with the clock set to the correct time, the doorbell disable time and enable time entered correctly, the message to be displayed selected and the occupant s name entered, the doorbell controller is ready for operation.

In operation, when a visitor arrives, he finds the occupant s name displayed to ensure he is at the correct address. When the visitor presses the doorbell pushbutton switch, a tone will direct attention to the message display. If the visitor has arrived during the time the doorbell is disabled, the message will advise the visitor whether to knock on the door, not disturb the occupant, or that the occupant is a daytime sleeper. These messages, though typical, are examples only and these and additional or other messages can be programmed into the system at the factory level. In a more sophisticated embodiment, the occupant can enter desired messages in the same manner the occupant's name is entered. Should the occupant, for any reason, desire normal operation during the disable period, the manual on/off switch can be pressed to override the controller. Automatic control is again established by pressing the manual on/off switch once again.

Figure 5:
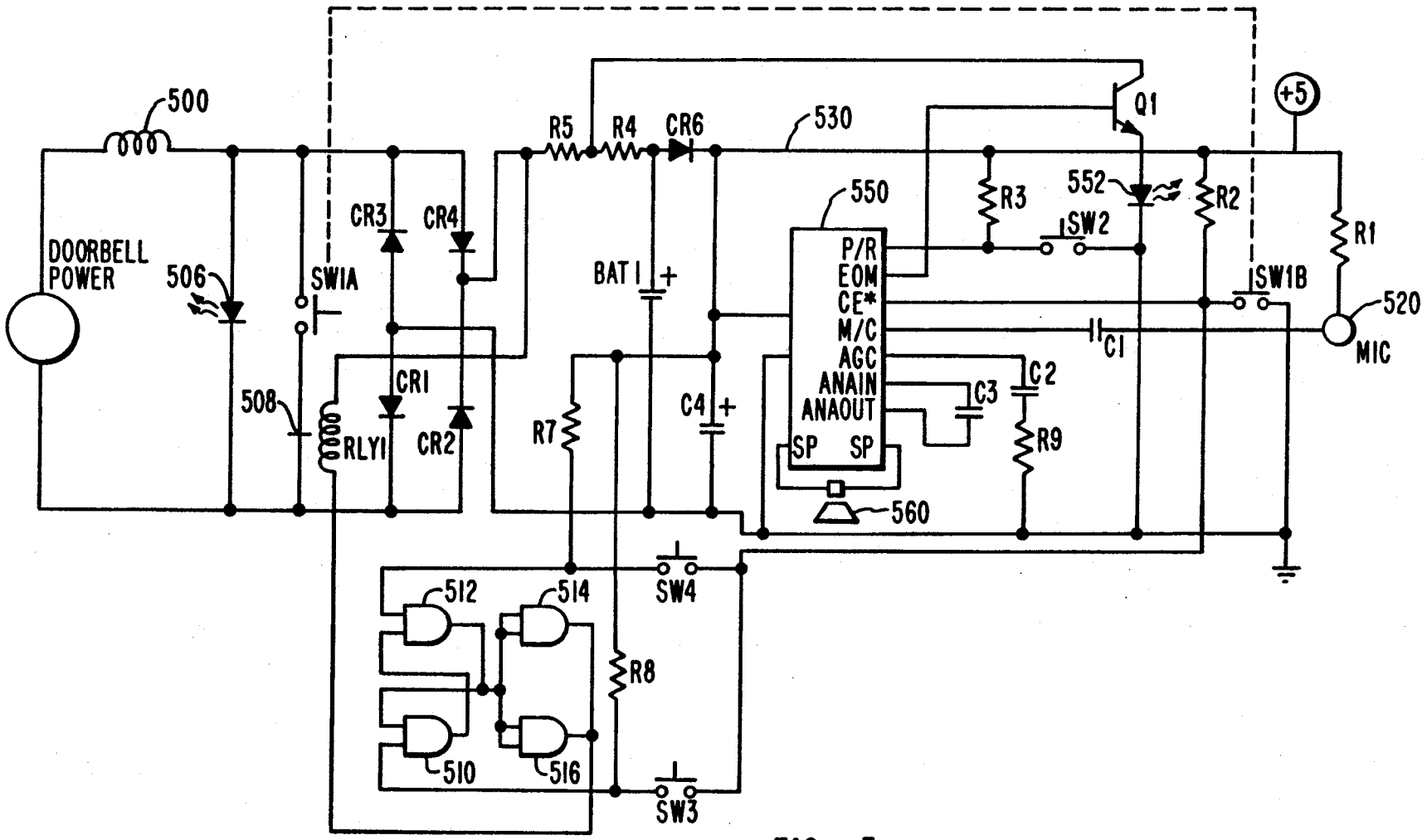
FIG. 5 is a circuit diagram of another embodiment which records and generates an audible announcement.

A circuit diagram of another embodiment of the invention is shown in FIG. 5. This embodiment has the advantage that the occupant can "program" the message by speaking into a microphone to generate a stored message. The stored message is later played back when the doorbell switch is pushed. Thus, this embodiment can be sold or used in various countries where different languages are spoken. Since there is no pre programmed message, exactly the same circuitry can be used in all languages. Although the embodiment shown in FIG. 5 does not include a timer, the speech storage and retrieval circuitry disclosed can be used in place of the message display 18 and tone generator 36 shown in FIG. 2 of the previous embodiment.

As shown in FIG. 5, electrical power is applied to the electronic doorbell from the existing house AC or DC power supply through existing house doorbell wiring. Doorbell power supplies in various areas may be AC or DC voltage of varying magnitude and the existing wiring may have variable current carrying capacity. In addition, normal operation of the doorbell pushbutton switch operates existing doorbell 500 by shorting existing wires 502 and 504 together. This short circuit removes power from the doorbell circuit when the circuit needs power to playback messages. Accordingly, the illustrative embodiment generates an internal DC voltage which is stabilized by an internal battery. Thus the illustrative doorbell can operate with virtually any voltage and wiring.

In particular, incoming electrical power (either AC or DC) is rectified to generate DC power by diodes CR1-CR4 which are connected as a full-wave bridge rectifier. Due to the rectifier circuit, even if the doorbell is connected to DC power, it is impossible to connect it with improper polarity. Assuming that the existing house power is AC, the pulsing DC power generated by diode bridge CR1-CR4 is clipped to a predetermined voltage level by resistor R5 and Zener diode CR5. The clipped voltage is used to continuously trickle charge nickel cadmium battery BAT1 through resistor R4. Resistor R4 is set to provide a current of 1/100 of the battery capacity, to allow for continuous charging. The resulting voltage is a regulated voltage that will always be available. The regulated voltage is reduced to a final value by series-connected diode CR6. The resulting final voltage on line 530 is then used as needed to power the electronic doorbell circuits.

For convenience, a light emitting diode (LED) 506 is connected across wires 502 and 504. The small current which flows through, and activates, LED 506 is not sufficient to activate doorbell 500, but LED 506 illuminates the doorbell pushbutton switch SW1B. When switch SW1B is pressed, the LED 506 will be shorted by switch SW1B and LED 506 will go out. The higher current flow through switch SW1B, wires 502 and 504 and relay contact 508 activates doorbell 500. This operation is identical with conventional illuminated, mechanical doorbell buttons.

Relay RLY1 is used to silence existing bell 500 when desired by the occupant. Relay is an AC relay powered by the unregulated pulsing DC output of rectifier bridge CR1-CR4. In order to silence bell 500, the occupant presses the doorbell button. The doorbell button closes switches SW1A and SW1B which are mechanically ganged together. Simultaneously, the occupant momentarily presses either pushbutton switch SW4 switch (BELL ON), or switch SW3 (BELL OFF).

When switch SW3 has been pressed to silence bell 500, a "low" ground signal passes through closed switch SW1A and closed switch SW3 and is applied to one input of NAND gate 510. The output of NAND gate 510 immediately becomes "high" in response. This "high" signal is provided to one input of NAND gate 512 and, in conjunction with a "high" present at the other input of NAND gate 512 forces its output "low". This "low" output is thereupon provided to one input of NAND gate 510 and holds its output "high" even when the doorbell buttons are released. NAND gates 510 and 512 thus act as a flip flop memory circuit.

The "low" output of NAND gate 512 is provided to NAND gates 514 and 516 which act as buffers in order to generate a higher current output to drive relay RLY1. In response to the "low" input, gates 514 and 516 generate a "high" output prevents relay RLY1 from operating. Since relay RLY1 has a normally open contact 508 in series with doorbell switch SW1B, current cannot flow to doorbell 500 when a visitor later presses the doorbell switch SW1B.

In order to allow doorbell 500 to operate when switch SW1B is pressed, the occupant simultaneously presses switches SW1A and SW4. A "low" ground signal is applied to the upper input of NAND gate 512 via switch SW1A and SW4. The output of NAND gate 512 immediately goes "high" in response. This "high" signal is applied to the upper input of NAND gate 510 and, in conjunction with the "high" signal at the lower input of NAND gate 510 forces the output of NAND gate 510 "low", thus resetting the flip flop. A "high" signal at the output of NAND gate 512 is inverted by NAND gates 514 and 516 and applied as a "low" signal to relay RLY1. This "low" signal activates relay RLY1, closing its normally open contact 508 and allows current to flow when a visitor presses the doorbell switch SW1B.

In order to record, store and playback messages, a spoken message is processed by integrated circuitry which first converts the audio message into digital signals. The digital signals can then be stored in an inexpensive digital memory until playback. During playback the stored digital signals are used to drive a speech synthesizer which generates an audio playback announcement.

Figure 6:
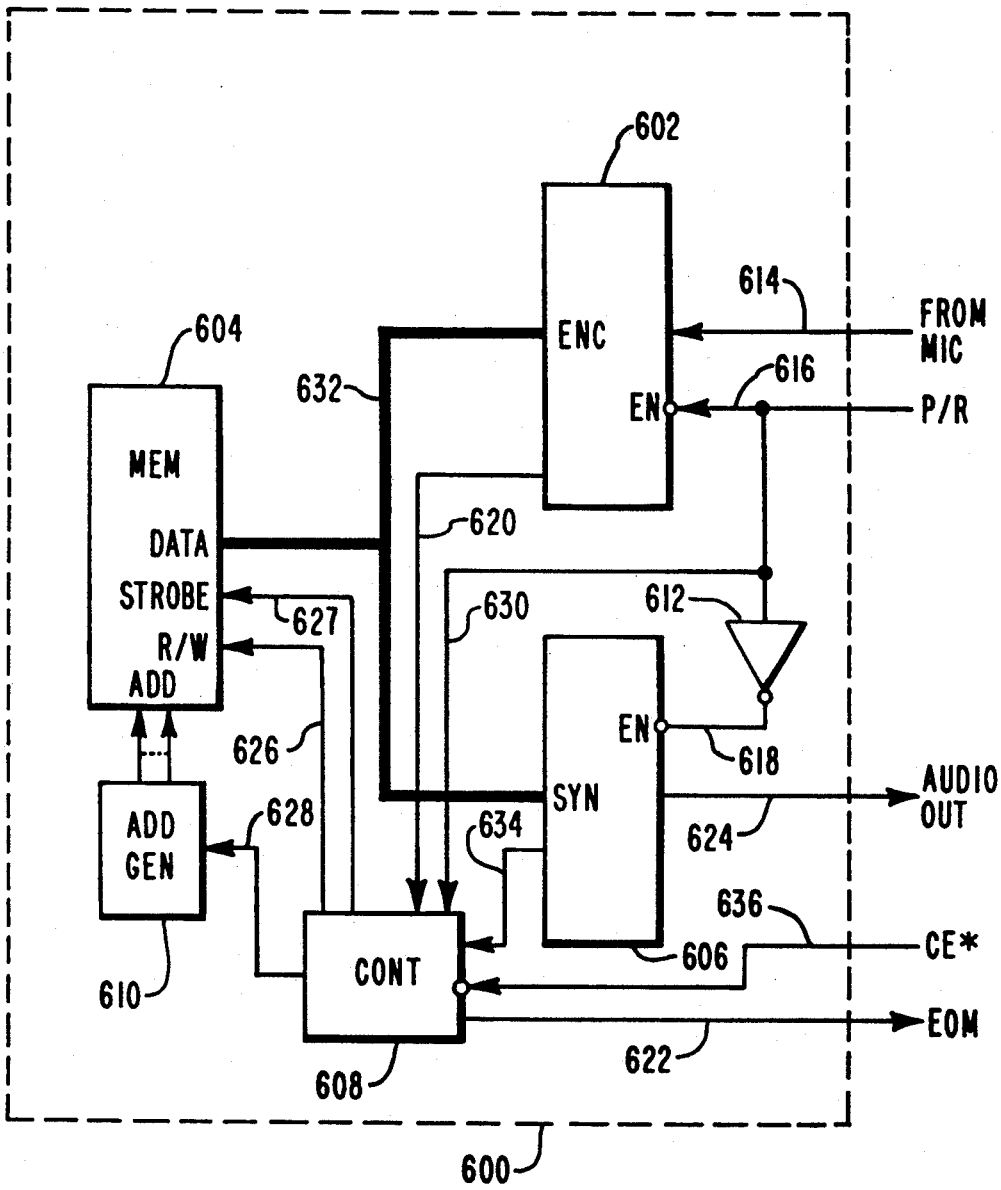
FIG. 6 is a block schematic diagram of the speech recording and playback circuitry.

The general arrangement of the digital circuitry is shown in the block diagram form in FIG. 6. The record and playback circuitry 600 consists of speech encoder circuit 602, digital memory 604, speech synthesizer 606, control circuit 608 and address generator 610. The playback and record mode of the circuit is controlled by the signal on the P/R line 616. A "low" signal on this line places the circuit in "record" mode and a "high" signal on Line P/R places the circuit in the "playback" mode.

In the "record" mode, a "low" signal on line 616 is applied to the enable input EN of the speech encoder circuit which "low" signal enables the chip. The "low" signal on line 616 is also inverted by inverter 612 and applied as a "high" signal to disable speech synthesizer circuit 606 which is used during the playback mode of operation. The "low" signal is further applied to to the control circuit 608, via line 630, which "low" signal informs control circuit 608 that record mode is desired.

Recording is actually initiated by a "low" signal received on the chip enable CE* line 636. In response thereto, control circuit 608 places a signal on line 626 which signal is applied to the read/write (R/W) input of memory 604 causing the memory to be placed in a write mode. Control circuit 608 also controls address generator 610 to generate address signals which are applied to the memory address inputs of memory 604 and applies a "high" signal on the end of message line (EOM) 622 to indicate that recording has started.

Speech encoder 602 receives analog audio signals on line 614 from a microphone (not shown in FIG. 6). Encoder 602 samples the audio signals and generates a digital word on data bus 632 which provides the digital signals to the data inputs of memory 604. Although bus 632 is shown as a single heavy line, typically it would consist of a plurality of signal lines since the digital words generated by encoder 602 have multiple bits. When encoder 602 has placed a digital word on data bus 632 it signals control circuit 608 via line 620.

In response to the signals from encoder 602, control circuit pulses memory strobe line 627 causing the digital word on bus 632 to be stored in memory 604 at the address generated by address generator 610. Control circuit 608 then controls address generator 610 to generate another address for the next digital word.

Operation continues in this manner with encoder 602 generating digital words which are sequentially stored in memory 604 until memory 604 is full or the "low" signal on playback record line 616 is removed. When either of the latter two conditions occurs, speech conversion is ended and control circuit places a "low" signal on the end-of-message EOM line 622 as a signal that recording has been completed. If the memory 604 is not full when recording is finished, control circuit 608 generates an "end-of message signal which is recorded in memory 604 to mark the last digital word.

During playback operation, a "high" signal is placed on the playback/record line 616. This "high" signal is provided to the enable input of encoder circuit 602 to disable the circuit. The "high" signal on line 616 is also inverted by inverter 612 and applied as a "low" signal to the enable input (EN) of speech synthesizer circuit 606 to enable the circuit. The "high" signal is also applied, via line 630, to control circuit 608 to place the control circuit in the playback mode. As with recording, playback is initiated by a "low" signal received at the chip enable input CE*.

In the playback mode, control circuit 608 places a signal on line 626 which signal is applied to the read/-write input (R/W) of memory 604 to place the memory in a read state. Control circuit 608 also controls address generator 610 to generate address signals for retrieving the first digital word. Control circuit 608 then pulses strobe line 627, causing memory 604 to place the stored digital word at the location indicated by the address signals onto data bus 632.

The digital signals on bus 632 are applied to speech synthesizer 606. In response to these signals synthesizer 606 generates corresponding audio signals on the AUDIO OUT line 624. When conversion of the digital signals is complete, synthesizer 606 signals control circuit 608 via line 634. Control circuit 608 thereupon control address generator to generate the next address so that the next stored digital word can be retrieved from memory 604. Operation continues in this manner with sequential digital words being retrieved from memory 604 and converted to speech signals by synthesizer 606 until the entire message has been read out of memory 604 as indicated by reading the entire message out or by reading out the stored end of-message marker.

The operation of the message recording and playback circuitry will not be discussed further herein because the construction and operation of the circuitry is conventional and well known. For example an integrated circuit which includes the speech encoder, decoder and associated control circuitry is manufactured by Texas Instruments, Inc. located at P.O. Box 225012-MS-84, Dallas, Tex. under the model number TMS 3477. This latter circuit can be combined in a straightforward fashion with a digital memory to produce the illustrative playback and recording circuitry.

Alternatively, a preferred playback and record circuit consisting of all the components shown in FIG. 6 plus input and output audio amplifiers is sold as a single integrated circuit designated as an "Integrated Voice Recorder (IVR) manufactured by Information Storage Devices, 2332B Walsh Avenue, Building G, Santa Clara, Calif., 95051. In the preferred embodiment discussed below the IVR circuit is described, but it should be understood that the above mentioned TMS 3477 circuit with an accompanying memory can be substituted in a straightforward manner.

Returning to FIG. 5, the record and playback sequence will be discussed. More specifically, in order to record a message which will be announced to a visitor when switches SW1B and SW1A are closed by pressing the doorbell button, the occupant simultaneously presses record pushbutton switch SW2 and the doorbell button which closes switch SW1A. While holding both switches closed, the occupant speaks into microphone 520. Microphone 520 connects from power line 530 to the microphone input MIC of circuit 550 through DC blocking capacitor C1. The MIC input is connected to an internal audio amplifier whose output appears at the ANAOUT output. Capacitor C3 is used to connect the amplified analog signal to the ANAIN input of circuit 550 which is the input to the analog recording logic in circuit 550.

When closed, switch SW2 places a "low" on the playback/record (P/R) input of the record/playback circuit 550. As previously mentioned, the "low" signal places the playback/record circuit into a "playback" mode. Closed switch SW1A provides an "enable" signal to the chip enable input CE* of circuit 550 which, as previously described above, starts a recording operation.

As previously mentioned, circuit 550 places a "high" signal on the EOM end of-message output when recording. The "high" signal on the EOM output is provided to transistor Q1 via resistor R6. The "high" signal from the EOM output turns transistor Q1 "on", allowing current to flow through Q1 to LED 552, in turn, activating LED 552. The resulting light from LED 552 gives the occupant a visible indication that a recording is being made.

When the record switch SW2 or doorbell button SW1A is released by the occupant or the recording capacity of circuit 550 is exceeded, an end of message marker is recorded in circuit 550 and the EOM output becomes "low". Consequently LED 552 is de activated. The occupant then knows that recording of the message is finished.

Subsequently when a visitor presses the doorbell switch, playback of the recorded message is initiated. More specifically, when a visitor presses the doorbell button switches SW1A and SW1B are closed. Since the record switch SW2 is not pressed at this time a "high" signal is provided via resistor R3, to the P/R input of circuit 550 to place it in the playback mode. Closed switch SW1A applies a "low" signal to the chip enable input CE* of circuit 550 which then activates the playback of the message as described above. The EOM output of circuit 550 will become "high" during playback, activating LED 552. When the message finishes playing, LED 552 will go off.

Resistor R2 and capacitor C2 make up an R/C network which is used to generate an automatic gain control voltage for circuit 550 if the aforementioned IVR circuit is used. As the occupant speaks louder during message recording, the gain of the input amplifier will be decreased. As the occupant speaks softer, the gain will be increased correspondingly.

For the aforementioned IVR circuit an output speaker 560 can be connected directly to speaker outputs SP.

Although only two embodiments of the invention have been described, it will be apparent to one skilled in the art that various modifications to the details of construction shown and described may be made without departing from the scope of this invention.

What is claimed is:

1. A programmable doorbell system for controlling a doorbell which is connected to, and activated by, a doorbell switch, said system comprising:

means for visually displaying a message;

means for generating time of day signals;

means responsive to a first one of said time of day signals for disconnecting said doorbell from said doorbell switch and for enabling said display means to display said message; and means responsive to a second one of said time of day signals for connecting said doorbell to said doorbell switch and for disabling said display means.

2. A programmable doorbell system according to claim 1 wherein said time-of day signal generating means comprises a clock for generating a time signal, a memory for storing an enable time and a disable time and means for comparing said time signal to said i stored enable signal to generate said first one of said time of day signals and to said stored disable signal to generate said second one of said time-of-day signals.

3. A programmable doorbell system according to claim 1 further comprising means responsive to sad first one of said time of day signals and responsive to the actuation of said doorbell switch by a visitor for generating an audible tone which alerts said visitor to examine a displayed message.

4. A programmable doorbell system according to claim 1 wherein said display means can display one of a plurality of messages and said doorbell system further comprises means for manually selecting one of said plurality of messages for display.

5. A programmable doorbell system according to claim 1 further comprising manually operated means for causing said disconnecting means to disconnect said doorbell from said doorbell switch and to enable said display means irrespective of said first one of said time of day signals.

6. A programmable doorbell system for controlling a doorbell which is connected to, and activated by, a doorbell switch, said system comprising:

means for visually displaying one of a plurality of messages;

a clock for generating a time signal;

a memory for storing the current time of day, an enable time and a disable time;

means responsive to said stored current time of day and to said stored enable time for disconnecting said doorbell from said doorbell switch and for enabling said display means to display said message when said current time of day equals said stored enable time; and means responsive to said stored current time of day and to said stored disable time for connecting said doorbell to said doorbell switch and for disabling said display means.

7. A programmable doorbell system according to claim 6 further comprising means responsive to said current time of day, to said stored enable time and to the actuation of said doorbell switch by a visitor for generating an audible tone which alerts said visitor to examine a displayed message.

8. A programmable doorbell system according to claim 7 wherein said doorbell system further comprises means for manually selecting said one of said plurality of messages for display.

9. A programmable doorbell system according to claim 8 further comprising manually operated means for causing said disconnecting means to disconnect said doorbell from said doorbell switch and to enable said display means irrespective of said stored current time of day and said stored enable time.

10. A self-contained electronic doorbell system for operation with a doorbell which is connected to an existing doorbell switch by existing electrical doorbell wiring, said system replacing said existing doorbell switch and comprising:

means for converting an audible announcement spoken by an occupant into digital signals;

a memory for storing said digital signals;

a pushbutton switch connected to said existing electrical doorbell wiring by said interfacing means to operate said doorbell when depressed;

a means for interfacing the doorbell system with said existing electrical doorbell wiring to generate electrical power for said system from electrical power present on said existing electrical doorbell wiring when the pushbutton switch is not depressed;

a self-contained power supply for providing electrical power for said system when said pushbutton switch is depressed;

means responsive to said stored digital signals and to actuation of said pushbutton switch for generating an audible reproduction of said audible announcement; and a weather resistant housing for housing the interfacing means, the converting means, the memory, the pushbutton switch and the audible reproduction generating means.

11. An electronic doorbell system according to claim 10 further comprising means for disconnecting said doorbell from said pushbutton switch so that said doorbell does not ring when said pushbutton switch is pushed, but said audible reproduction of said audible announcement is generated.

12. An electronic doorbell system according to claim 11 wherein said disconnecting means comprises a switch connected in series with said doorbell and said pushbutton switch and manually-controlled means for opening said switch to disconnect said doorbell and said pushbutton switch.

13. An electronic doorbell system according to claim 10 wherein said converting means comprises a microphone for converting said audible announcement into analog electrical signals and a speech encoder circuit for converting said analog electrical signals into digital signals.

14. An electronic doorbell system according to claim 10 wherein said means for generating an audible reproduction of said audible announcement comprises a speech synthesizer responsive to said stored digital signals for generating analog electrical signals and a speaker responsive to said analog electrical signals for generating said audible announcement.

15. A self-contained electronic doorbell system for operation with a doorbell which is connected to an existing doorbell switch by existing electrical doorbell wiring, said system replacing said existing doorbell switch and comprising:

means for interfacing the doorbell system with said existing electrical doorbell wiring for generating electrical power for said system from electrical power present on said existing electrical doorbell wiring;

a microphone for converting an audible announcement spoken by an occupant into analog electrical input signals;

a speech encoder circuit for converting said analog electrical input signals into a plurality of digital words;

memory means for storing said plurality of digital words;

a pushbutton switch connected to said existing electrical doorbell wiring by said means for interfacing to operate said doorbell;

means responsive to the actuation of said pushbutton switch for sequentially retrieving each of said plurality of digital words from said memory means;

a speech synthesizer responsive to each of said retrieved digital words for generating analog electrical output signals;

a speaker responsive to said analog electrical output signals for generating an audible announcement; and a weather resistant housing for housing the interfacing means, the microphone, the speech encoder, the memory means, the pushbutton switch, the retrieving means, the speech synthesizer and the speaker.

16. An electronic doorbell system according to claim 15 further comprising:

a switch connected in series with said doorbell and said pushbutton switch;

a flip-flop having a first and second circuit state, said flip-flop being connected to said pushbutton switch for closing said switch when said flip-flop is in said first state and for opening said pushbutton switch when said flip flop is in said second state; and first manually-controlled means for controlling said flip-flop to change between said first and second stages.

17. An electronic doorbell system according to claim 16 further comprising second manually controlled means for enabling said speech encoder and disabling said speech synthesizer to place said doorbell system in a recording mode and for disabling said speech encoder and enabling said speech synthesizer to place said doorbell system in a playback mode.

18. A programmable doorbell system for controlling a doorbell which is connected to, and activated by, a doorbell switch, said system comprising:

means for converting an audible announcement spoken by an occupant into digital signals;

a first memory for storing said digital signals;

means responsive to said stored digital signals for generating an audible reproduction of said audible announcement;

means for generating time of day signals;

means responsive to a first one of said time of day signals for disconnecting said doorbell from said doorbell switch and for enabling generating means to generate said audible reproduction of said audible announcement; and means responsive to a second one of said time of day signals for connecting said doorbell to said doorbell switch and for disabling said generating means.

19. A programmable doorbell system according to claim 18 wherein said time of day signal generating means comprises a clock for generating a time signal, a second memory for storing an enable time and a disable time and means for comparing said time signal to said stored enable signal to generate said first one of said time of day signals and to said stored disable signal to generate said second one of said time-of-day signals.

20. A self-contained electronic doorbell system for operation with a doorbell which is connected to an existing doorbell switch by existing electrical doorbell wiring, said system replacing said existing doorbell switch and comprising:

means for converting an audible announcement spoken by an occupant into digital signals;

a pushbutton switch connected to said existing electrical doorbell wiring for operating said doorbell;

a means for interfacing the doorbell system with said doorbell system with the existing electrical doorbell wiring to generate electrical power for said system from electrical power present on said existing doorbell wiring when the pushbutton switch is not depressed;

a self-contained power supply for providing electrical power for said system when said pushbutton is depressed;

means responsive to said stored digital signals and to depression of said pushbutton switch for generating an audible reproduction of said audible announcement; and a weather resistant housing for housing the power supply, the converting means, the memory, the pushbutton switch and the audible reproduction generating means.

* * * * *